US005439072A

United States Patent [19]

Jenkins, Jr.

[11] Patent Number: 5,439,072

[45] Date of Patent: Aug. 8, 1995

[54] MODULAR LADDER SYSTEM

[76] Inventor: Joseph R. Jenkins, Jr., 12203 Becontree Dr., Baton Rouge, La. 70810

[21] Appl. No.: 214,835

[22] Filed: Mar. 17, 1994

[51] Int. Cl.[6] ..... E06C 1/10

[52] U.S. Cl. ..... 182/100; 182/93; 182/207

[58] Field of Search ..... 182/100, 187, 133, 206, 182/207, 93, 189, 195

[56] References Cited

U.S. PATENT DOCUMENTS

| | | | |
|---|---|---|---|
| 3,033,309 | 5/1962 | Fugere | 182/195 X |
| 3,995,714 | 12/1976 | Brookes | 182/100 |
| 4,263,983 | 4/1981 | Norton | 182/100 X |
| 4,355,701 | 10/1982 | Nicholson | 182/207 X |
| 4,388,983 | 6/1983 | Bartels | 182/100 X |
| 4,592,446 | 6/1986 | White | 182/100 X |
| 4,844,207 | 7/1989 | Andrews | 182/100 X |
| 5,109,954 | 5/1992 | Skyba | 182/100 X |

*Primary Examiner*—Alvin C. Chin-Shue

*Attorney, Agent, or Firm*—Warner J. Delaune

[57] ABSTRACT

A modular ladder system for climbing trees is provided, comprising at least two ladder modules, each ladder module comprising a hollow, primary support member having an upper end and a lower end; a secondary support member, telescopingly slidable within the primary support member, having an upper end and a lower end; a first step attached to the lower end of the secondary support member; a second step attached to the lower end of the primary support member; a top step attached to the upper end of the primary support member; a spring-loaded lock operatively disposed between the primary support member and the secondary support member for locking the position of the secondary support member relative to the primary support member; at least two stabilizer brackets attached to the primary support member and the secondary support member for stabilizing the ladder module against the tree; and a strap and quick-release buckle attached to the primary support member for holding the ladder module to the tree.

6 Claims, 4 Drawing Sheets

MODULAR LADDER SYSTEM

BACKGROUND OF THE INVENTION

I. Field of the Invention

The present invention relates generally to ladders, and more particularly to modular ladder systems for climbing trees.

II. Description of Prior Art

In the sport of hunting, especially when the quarry is deer, the use of a treestand is a very common practice. The treestand offers many advantages, such as enabling the hunter to view his surroundings from an elevated vantage point, and minimizing the chances of being spotted or smelled by the deer. Therefore, development of treestand technology to facilitate the achievement of these objectives has been quite progressive, focusing on both portability and adaptability. Despite the advances made in this filed, however, there still remains the problem of actually climbing the tree to set up the treestand, and a number of prior techniques have been attempted with varying levels of success. Several of these devices are explained below, and each one offers the hunter a unique balance of portability, strength, stability and adaptability to the tree-climbing environment.

The simplest ladder known in the prior art, other than simply using the branches of the tree, is the conventional ladder having two parallel members connected by perpendicular rungs. Whether such a ladder has a unitary construction or is an extension ladder, it is extremely cumbersome for carrying through dense woods and is oftentimes quite heavy. Also, such ladders are necessarily straight and may not be well suited for use with a tree having an irregular shape. Finally, under the adverse conditions presented by most hunting environments, a conventional ladder is typically unstable and dangerous.

To overcome the problem of portability associated with conventional ladders, a number of alternative designs have been attempted. Some devices simply include two or more sections or modules of conventional ladder design which connect end-to-end, and the resulting assembly is tied to the tree to improve stability. While these designs made headway in improving portability, they remain ill-suited for use with trees having an irregular axis or many low branches which interfere with the long straight-line distance that the ladder is meant to span.

Another alternative design also comprises a number of connected modules, where each module has a single vertical member from which several steps are placed perpendicularly thereto. Some models have the steps offset from one another, such as in the case of the "Po-Jo Climbing Pole" manufactured by Amacker International, Inc., in Delhi, La. In other models, the steps are formed in a continuing T-configuration with respect to the vertical member, as seen in the "Sky Ladder" manufactured by Loc-On Company in Greensboro, N.C. The assembled ladder is then either tied to the tree with a rope or strap, or attached to the tree by a set of metal tongs. One of the advantages of such devices are that they are more lightweight than those ladders employing parallel vertical members. In those ladders where the steps are arranged in a continuing T-configuration, another purported advantage is that the climber is afforded the ability to place both feet on the same level while climbing, resulting in a more comfortable and stable climb.

Despite their apparent advantages, none of the above devices have addressed the problem of trees which have: (1) so-called "bell bottoms", or unusually wide trunks, such as cypress and tupelo trees typical in the southern United States; (2) a main vertical axis which is very irregular; or (3) many low-level branches which do not allow for a continuous ladder spanning a large distance to the treestand.

However, the ladder modules marketed under the trademark "Speed Steps" by Alumitech Industries, Inc., in Mamou, La., are an attempt to overcome those unique concerns. That ladder system is essentially a number of mini-ladders of conventional design which are separately attachable to the tree, except that the tips of the parallel rails at both ends are curved toward the tree to provide a four-point contact. While it is an improvement over prior devices to some extent, several weaknesses are apparent. First, the double-rail design does not allow the climber to place both feet on the same level at some point on the module, and is somewhat bulky when carried with other modules. Second, the modules are not internally adjustable in any way, so they cannot make maximum use of the existing tree structure, and they cannot be made more compact for storage and transportation. What is needed, therefore, is a modular tree ladder system which is conveniently portable, strong, stable, and adaptable to a variety of tree climbing environments.

SUMMARY OF THE INVENTION

It is therefore an object of this invention to provide a portable tree ladder system which is strong, compact and lightweight.

It is also an object of this invention to provide a portable tree ladder system which is highly adaptable to the particular tree climbing situation.

It is a further object of this invention to provide a portable tree ladder system whose modules are adjustable in length.

Yet another object of this invention is to provide a portable tree ladder system which is safe and stable when used.

These and other objects and advantages of the present invention will no doubt become apparent to those skilled in the art after having read the following description of the preferred and alternate embodiments, which are contained in and illustrated by the various drawing figures.

Therefore, in a preferred embodiment, a modular ladder system for climbing trees is provided, comprising at least two ladder modules, each said ladder module comprising a hollow, primary support member having an upper end and a lower end; a secondary support member, telescopingly slidable within said primary support member, having an upper end and a lower end; a first step attached to said lower end of said secondary support member; a second step attached to said lower end of said primary support member; a top step attached to said upper end of said primary support member; locking means operatively disposed between said primary support member and said secondary support member for locking the position of said secondary support member relative to said primary support member; means attached to said primary support member and said secondary support member for stabilizing said ladder module against said tree; and means attached to said primary support member for holding said ladder module to said tree.

DETAILED DESCRIPTION OF THE PREFERRED AND ALTERNATE EMBODIMENTS

Figure 1:
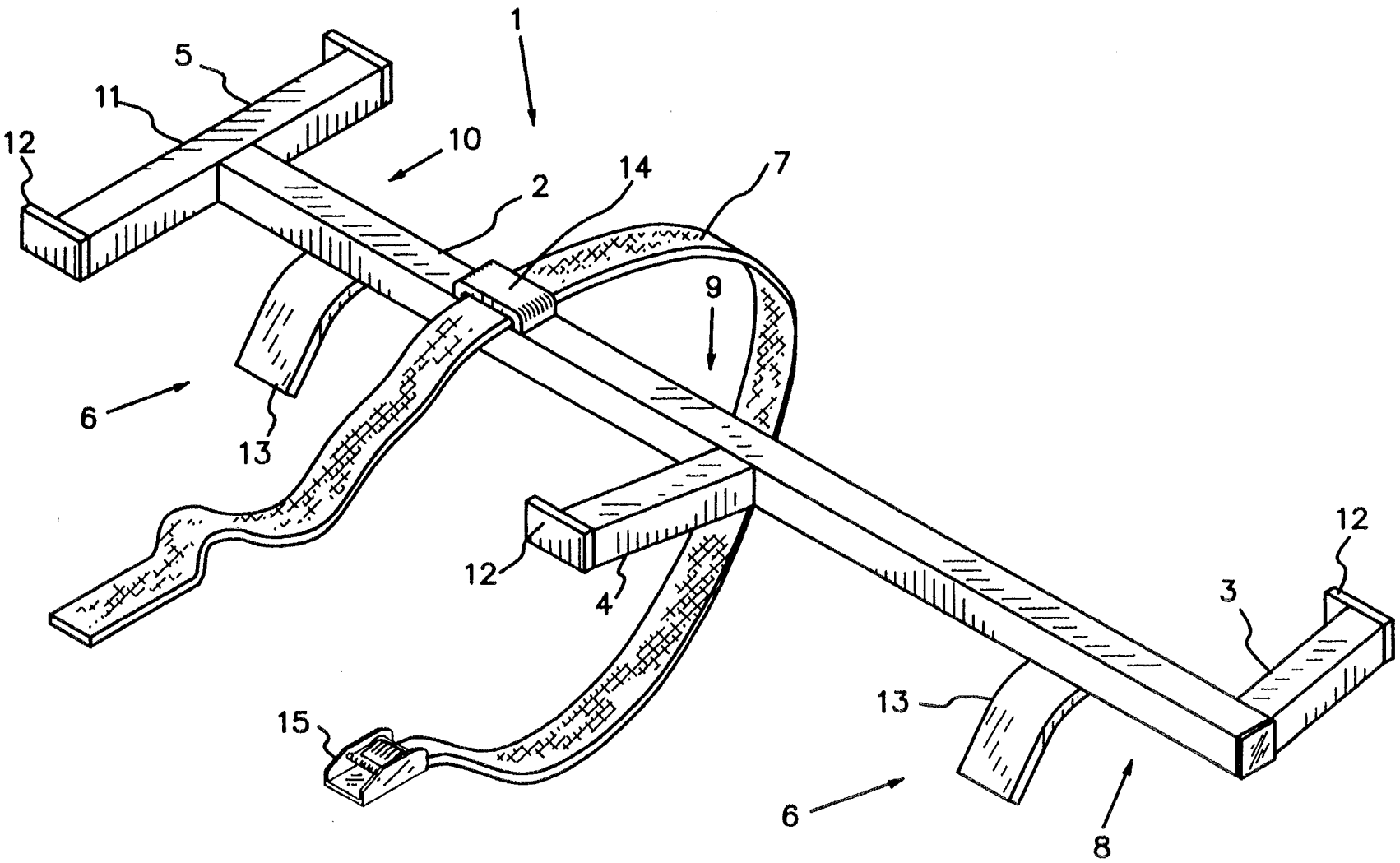
FIG. 1 is a perspective view of a preferred embodiment of the invention.

In the drawings many details pertaining to fabrication and maintenance utility well established in the machine construction art and not bearing upon points of novelty are omitted in the interest of descriptive clarity and efficiency. Such details may include threaded connections, lockrings, shear pins, weld lines and the like. Also, the spreading use of electron beam welding eliminates many such features and leaves no visible distinctive lines.

Turning now to FIG. 1, a tree ladder module 1 is shown generally comprising a support member 2, first and second steps 3,4, top step 5, stabilizing means 6, and strap 7. Support member 2 preferably consists of a straight, rigid section of aluminum tubing having a lower end 8, a middle portion 9, and an upper end 10. In keeping with the goal of being lightweight and strong, the cross section of support member 2 has square dimensions of $1\frac{1}{4}'' \times 1\frac{1}{4}''$ with a wall thickness of 1/16". The overall length of ladder module 1 is approximately three feet (3'), which makes it quite easy to be carried during a hunting trip, but can be manufactured to any length.

First and second steps 3,4 are simply short sections of aluminum tubing attached to lower end 8 and middle portion 9, respectively, preferably by welding. As shown best in FIGS. 2A and 2B, the angle A between first and second steps 3,4 and support member 2 should be less than 90 degrees so that a foot can be wedged therein during climbing. Top step 5 is also constructed of aluminum tubing and is perpendicularly attached at its midpoint 11 to upper end 10 of support member 2. For reasons of safety, it is preferable for first and second steps 3,4 and top step 5 to include retaining tabs 12 rigidly attached to the ends of each step. Retaining tabs 12, along with the inclined angle of first and second steps 3,4, help to prevent slippage of the climber's shoe from the ladder module 1 during climbing. Advantageously, top step 5 permits the climber to place both boots on the same level when standing on top of ladder module 1. As an added safety feature, first and second steps 3,4 and top step 5 should also include a upper non-slip, or abrasive, surface (not shown) for contact with the climber's sole of the shoe or boot. This non-slip surface can be added by any one of several methods widely known to those of ordinary skill, such as by an abrasive paint, an adhesive strip having embedded abrasive material, or by forming irregularities into the steps during manufacturing.

To ensure that ladder module 1 is anchored firmly to the tree and to provided a means for spacing the ladder module 1 away from the tree to leave room for the climber's shoes, stabilizing means 6 is attached to support member 2. In the figures, stabilizing means 6 is comprised of a pair of curved sections of aluminum channel stock 13 welded to the upper end 10 and lower end 8 of support member 2. Channel stock 13 consists of an elongated, flat portion having two extending parallel edges, and is curved into a C-shape so that the extending parallel edges conform roughly to the curvature of the tree to be climbed. Channel stock 13 is attached to upper and lower ends 8,10 of support member 2 along the flat portion opposite the parallel edges. Providing at least two such points of contact against the tree prevents the ladder module 1 from moving relative to the tree and creates a more stable structure. Strap 7 is held to ladder module 1 by a loop 14 permanently attached to upper end 10 of support member 2, and is long enough to completely wrap around the tree to be climbed. A self-tightening, quick-release buckle 15 is included which ensures that ladder module 1 will remain attached to the tree during climbing when strap 7 is placed in tension.

Figure 2A:
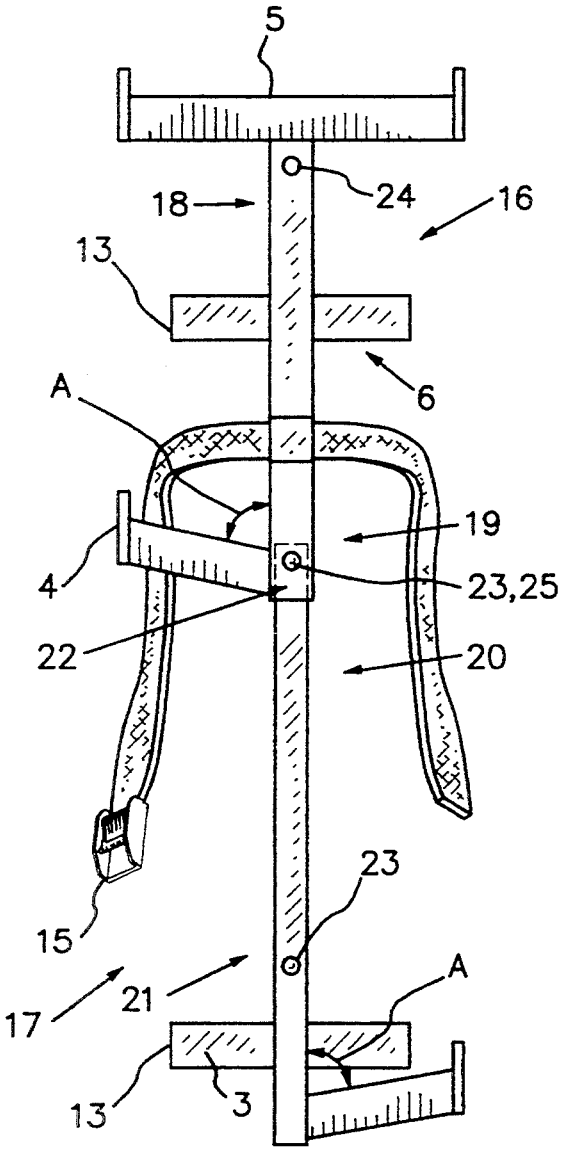
FIGS. 2A and 2B are side views of an alternate embodiment of the invention which is adjustable.
Figure 2B:
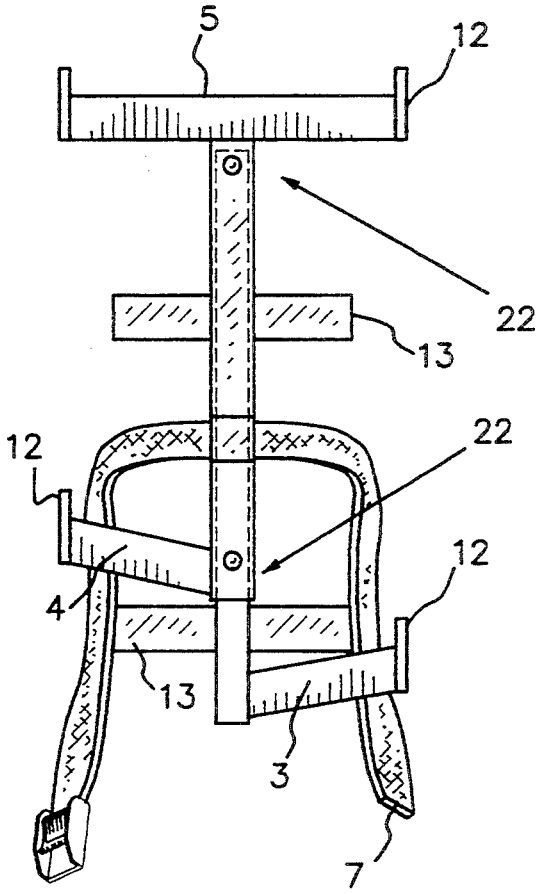

In the alternate embodiment depicted in FIGS. 2A and 2B, an adjustable ladder module 1 is provided whose length can be changed to suit the needs of the user. This embodiment is very similar to the one described above, but generally comprises a hollow, primary support member 16 into which a secondary support member 17 is telescopingly slidable. Primary support member 16 can be constructed from the same material as in the preferred embodiment, and includes an upper end 18 and a lower end 19, as well as a loop 14, strap 7, and buckle 15 as described earlier. Primary support member 16 should have a length of approximately 20 inches. Second step 4 is a short section of aluminum tubing attached at the lower end 19 of primary support member 16, while top step 5 is attached at its midpoint 11 to the upper end 18 of primary support member 16. A part of the stabilizing means 6, namely channel stock 13, is also attached at its flat portion to primary support member 16. Retaining tabs 12 are included on the end of second step 4 and both ends of top step 5 to prevent slippage of the climber's boot during climbing.

Secondary support member 17 also includes an upper end 20 and a lower end 21, and it is constructed of the same material as primary support member 16. The length of secondary support member 17 should be approximately 20 inches. However, it must be of a cross section which will slide into and out of primary support member 16. Preferably, there should be a relatively tight fit between primary and secondary support members 16,17, so that when the ladder module 1 is in an extended position, there will be little movement between primary and secondary support members 16, 17. First step 3 is attached to lower end 21 of secondary support member 17 in the same manner as in the preferred embodiment. The complementary portion of stabilizing means 6, in the form of channel stock 13, is attached along its flat portion to the distal portion of lower end 21 of secondary support member 17. As in the case of second step 4 and top step 5, retaining tab 12 is also included on the end of first step 3 as a safety measure.

In a retracted position as shown in FIG. 2B, secondary support member 17 is held almost entirely within primary support member 16 by locking means 22. Locking means 22 can be any device which effectively prevents secondary support member 17 from sliding out of primary support member 16, such as a nut and bolt combination, or a spring loaded pin 23. If spring loaded pin 23 is employed, primary support member 16 will include first lock hole 24 at its upper end 18, and a second lock hole 25 at its lower end 19. Spring loaded pins 23 are located on secondary support member 17 at a distance apart to match with first and second lock holes 24,25 in a retracted position. In an extended position as shown in FIG. 2A, spring loaded pin 23 at the upper end 20 of secondary support member 17 will engage second lock hole 25 of primary support member 16. The relative locations of second lock hole 25 and spring loaded pin 23 on the upper end 20 of secondary support member 17 should be such that at least three inches (3") of secondary support member 17 should remain within primary support member 16.

Figure 3:
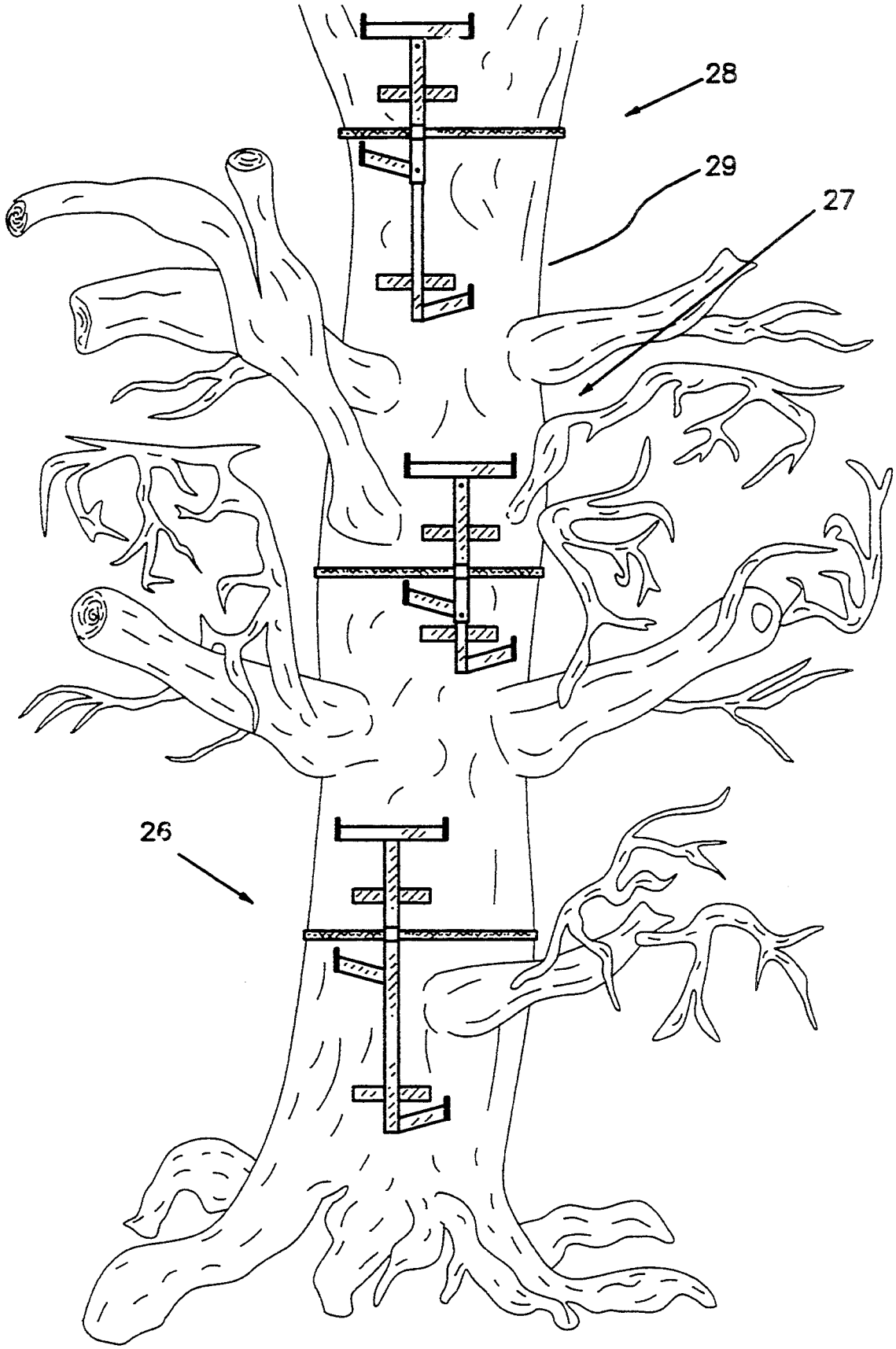
FIG. 3 depicts the preferred and alternate embodiments of the invention as attached to a tree.
Figure 4:
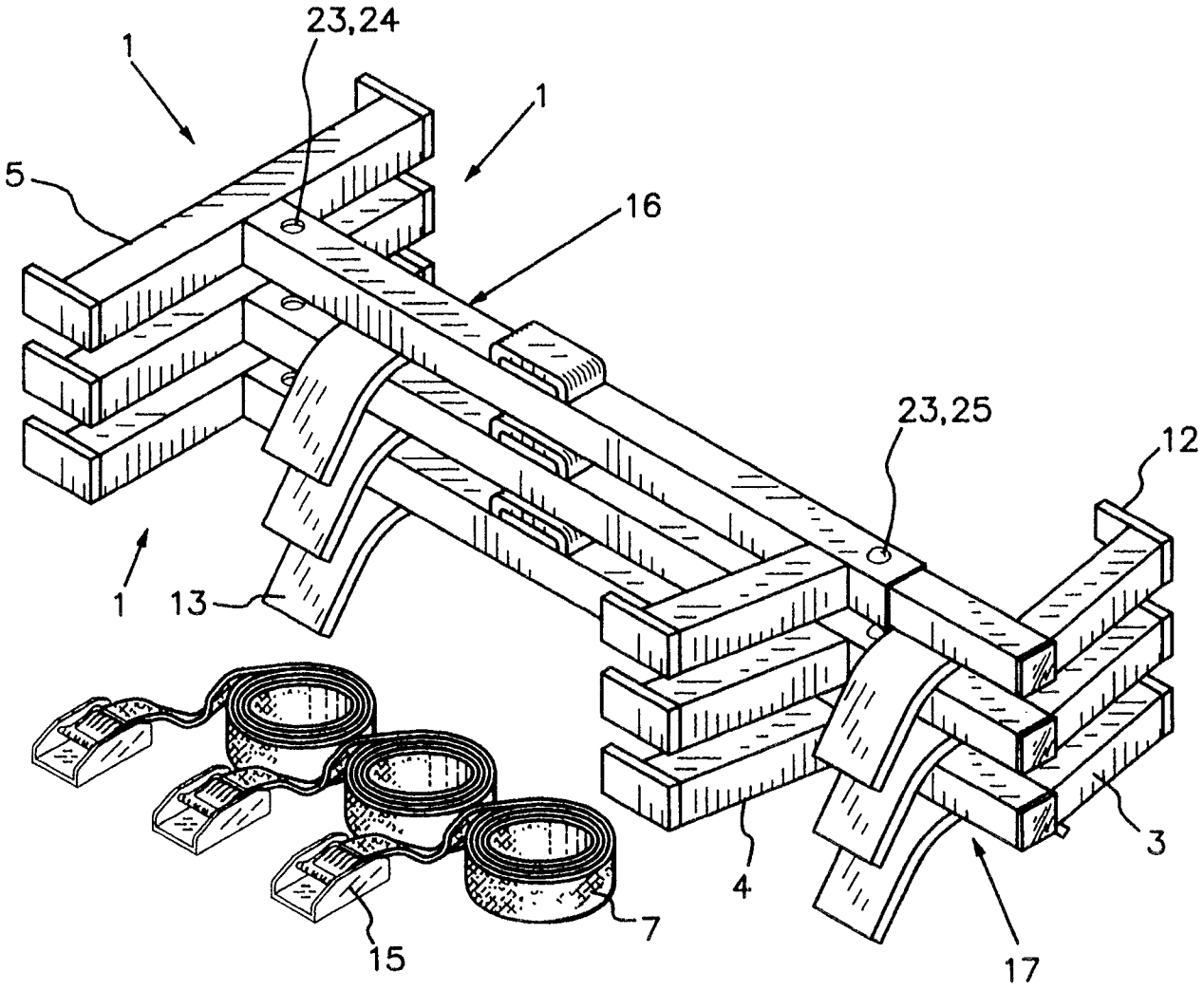
FIG. 4 shows several of the ladder modules depicted in FIGS. 2A and 2B in a stacked configuration for transportation.

In operation of the invention, FIG. 3 shows three ladder modules 1 attached to a tree 29. The bottom ladder module 26 is constructed in accordance with the preferred embodiment of FIG. 1, while the middle ladder module 27 and top ladder module 28 are constructed in accordance with the alternate embodiment of FIGS. 2A and 2B, in retracted and extended positions, respectively. It will be appreciated that the ability of the ladder module 1 to retract and extend offers advantages to hunters for at least two important reasons. First, as shown in FIG. 4, it is much easier to transport multiple ladder modules 1 to and from a hunting site when the ladder modules 1 are in a retracted position. Second, based on the particular branch structure of the tree 29 to be climbed, the climber has the option of either extending or retracting the ladder modules 1 of his choice to make maximum use of the tree branches and/or the ladder modules 1.

The overall concept of the foregoing embodiments of the invention is directed to providing a ladder system having a low-profile design for ease of carrying and storage. This design also helps the hunter in achieving a totally camouflaged appearance, because it is smaller and less bulky than competing designs. Furthermore, the thin structural components enable the ladder modules to be placed within very tight spaces among tree limbs, contrary to double-rail designs seen in the prior art. Also, when providing the same number of steps as prior art double-rail designs, the present invention is actually shorter in length than the prior art, even when fully extended, because the 4-point contact with the tree is made between the steps.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A portable ladder module for climbing trees, comprising:

(a) a hollow, primary support member having an upper end and a lower end;

(b) a secondary support member, telescopingly slidable within said primary support member between a retracted position and an extended position, having an upper end and a lower end;

(c) a bottom step attached to said lower end of said secondary support member;

(d) a top step attached to said upper end of said primary support member, wherein said top step is sufficiently wide to accept both shoes of a climber;

(e) an intermediate step attached to said primary support member between said bottom step and said top step;

(f) locking means operatively disposed between said primary support member and said secondary support member for selectively locking the position of said secondary support member in either a retracted position or an extended position relative to said primary support member;

(g) means attached to said primary support member and said secondary support member for stabilizing said ladder module against said tree; and (h) means attached to said primary support member for holding said ladder module to said tree.

2. The ladder module of claim 1, wherein said bottom, intermediate and top steps include an upper nonslip surface.

3. The ladder module of claim 1, wherein said bottom, intermediate and top steps include a retaining tab extending upward from each of the ends thereof.

4. The ladder module of claim 1, wherein said bottom step is inclined with respect to said secondary support member, and said intermediate step is inclined with respect to said primary support member.

5. The ladder module of claim 1, wherein said stabilizing means comprises:

(a) a first section of channel stock attached to said upper end of said primary support member; and (b) a second section of channel stock attached to said lower end of said secondary support member; and wherein said first and second sections of channel stock are curved to conform to said tree.

6. The ladder module of claim 1, wherein said means for holding said ladder module against said tree comprises:

(a) a loop formed on said primary support member; and (b) a strap passed through said loop, and having a quick-release buckle.

* * * * *